United States Patent [19]

Meiners et al.

[11] Patent Number: 4,982,173

[45] Date of Patent: Jan. 1, 1991

[54] ROTATABLE TRIP TEST ASSEMBLY FOR MOLDED CASE CIRCUIT BREAKERS

[75] Inventors: David J. Meiners, Southington; Roger N. Castonguay, Terryville; David Arnold, Chester, all of Conn.

[73] Assignee: General Electric Company, New York, N.Y.

[21] Appl. No.: 486,681

[22] Filed: Mar. 1, 1990

[51] Int. Cl.[5] ..... H01H 73/02

[52] U.S. Cl. ..... 355/21; 335/14; 335/165

[58] Field of Search ..... 335/22, 26, 9, 13, 14, 335/17, 21, 165, 179

[56] References Cited

U.S. PATENT DOCUMENTS

| | | | |
|---|---|---|---|
| 3,214,537 | 10/1965 | Krieger | 335/22 |
| 3,430,164 | 2/1969 | Hurtle | 335/22 |
| 3,671,890 | 6/1972 | Klein et al. | 335/22 |
| 4,023,130 | 5/1977 | Ridler et al. | 335/219 |
| 4,740,768 | 4/1988 | Morris et al. . | |
| 4,754,247 | 6/1988 | Raymont et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A rotatable trip test assembly unit for molded case circuit breakers consists of a unitary plastic part that cooperates with the internal structure of the circuit breaker cover to provide return spring bias to the trip test button. The trip test assembly unit rotates about a pivot and strikes the circuit breaker trip bar to thereby articulate the circuit breaker operating mechanism and separate the circuit breaker contacts. The interaction between a cam-follower on the assembly unit and a cam-shaped piece within the circuit breaker cover automatically returns the trip test button to its initial position upon release.

17 Claims, 3 Drawing Sheets

ROTATABLE TRIP TEST ASSEMBLY FOR MOLDED CASE CIRCUIT BREAKERS

BACKGROUND OF THE INVENTION

U.S. Pat. No. 4,754,247 entitled "Molded Case Circuit Breaker Accessory Enclosure" describes a circuit breaker and accessory which are mainly assembled together in an automated manufacturing process. The circuit breaker rating plug and the accessory units are down-loaded within recesses formed in the circuit breaker cover during assembly with little or no manual intervention. A manually accessible trip test button is generally provided on the top surface of the circuit breaker cover to allow an operator to trip the circuit breaker operating mechanism to determine whether the circuit breaker mechanism is functional. There are several existing trip test button designs that rely upon the depression of the trip test button or the rotation thereof to effect internal contact with the circuit breaker operating mechanism.

One example of a two-piece circuit breaker "twist-to-trip" trip test button is found in U.S. Pat. No. 3,671,890 entitled "Manually Operable Molded Case Circuit Breaker With Special Trip Testing Means". The trip test button described therein is formed from two separate injection molded plastic pieces. The top piece consists of an externally accessible cylindrical trip test button positioned within a recess formed in the circuit breaker cover. A bottom piece includes a pair of angled legs wherein one of the legs interacts with the circuit breaker trip bar while the other leg resiliently interacts with a stop on the circuit breaker cover to return the trip test button to its original position. This Patent is incorporated herein for purposes of reference and should be reviewed for its teaching of the interaction of an externally accessible trip test button with the internal circuit breaker trip bar and operating mechanism.

One example of a "slide-to-trip" trip test button is found in U.S. Pat. No. 4,740,768 entitled "Manual Trip Operator for Molded Case Circuit Breaker" which Patent is incorporated herein for reference purposes. This Patent describes a single plastic trip operator that is down-loaded within the circuit breaker cover in a single automated assembly process and utilizes the resilience of the plastic material to return the trip operator to its initial position.

In some applications, a "push-to-trip" trip test button is required such as with a self-trip industrial-rated circuit breaker whereby the circuit breaker automatically becomes tripped by interaction between a trip projection formed on the associated circuit breaker enclosure and the trip test button on the circuit breaker when the circuit breaker is withdrawn from the enclosure.

One purpose of the instant invention, accordingly, is to provide a "push-to-trip" trip test button assembly unit that is assembled within a circuit breaker cover in an automated assembly process and is capable of self-trip function when utilized within a supplemental circuit breaker enclosure.

SUMMARY OF THE INVENTION

A unitary plastic test trip assembly unit incorporates means for rotating the unit into contact with a circuit breaker trip bar to articulate the circuit breaker operating mechanism. An elongated return arm on the unit includes a cam-follower formed at one end thereof which cooperates with a cam-shaped projection formed within the circuit breaker cover. Depression of the trip test button rotates the unit and drives the cam-follower along the cam-shaped projection to spring-bias the unit in the reverse direction. Release of the trip test button thereby automatically returns the trip test button to its initial rest position.

DESCRIPTION OF THE PREFERRED EMBODIMENT

Figure 1:
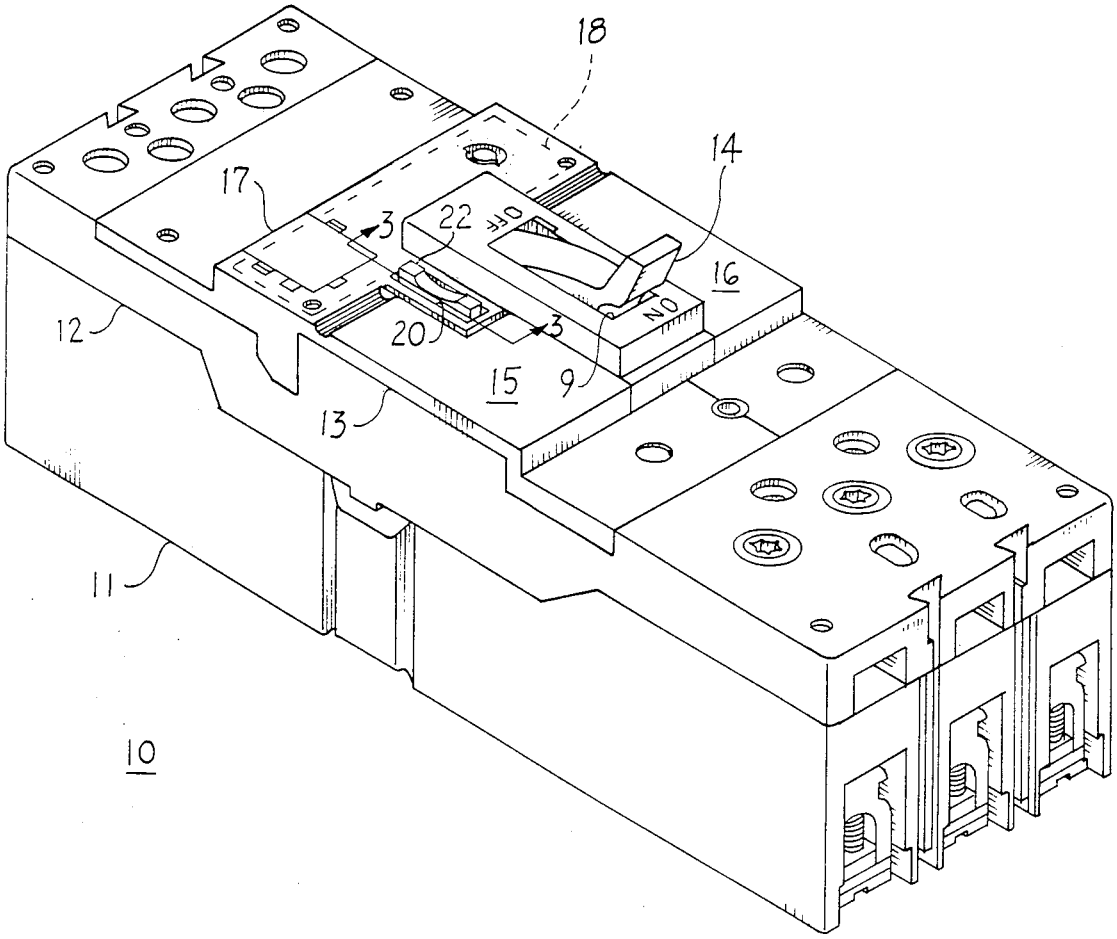
FIG. 1 is a top perspective view of an industrial-rated circuit breaker employing the trip test assembly unit according to the invention.
Figure 2:
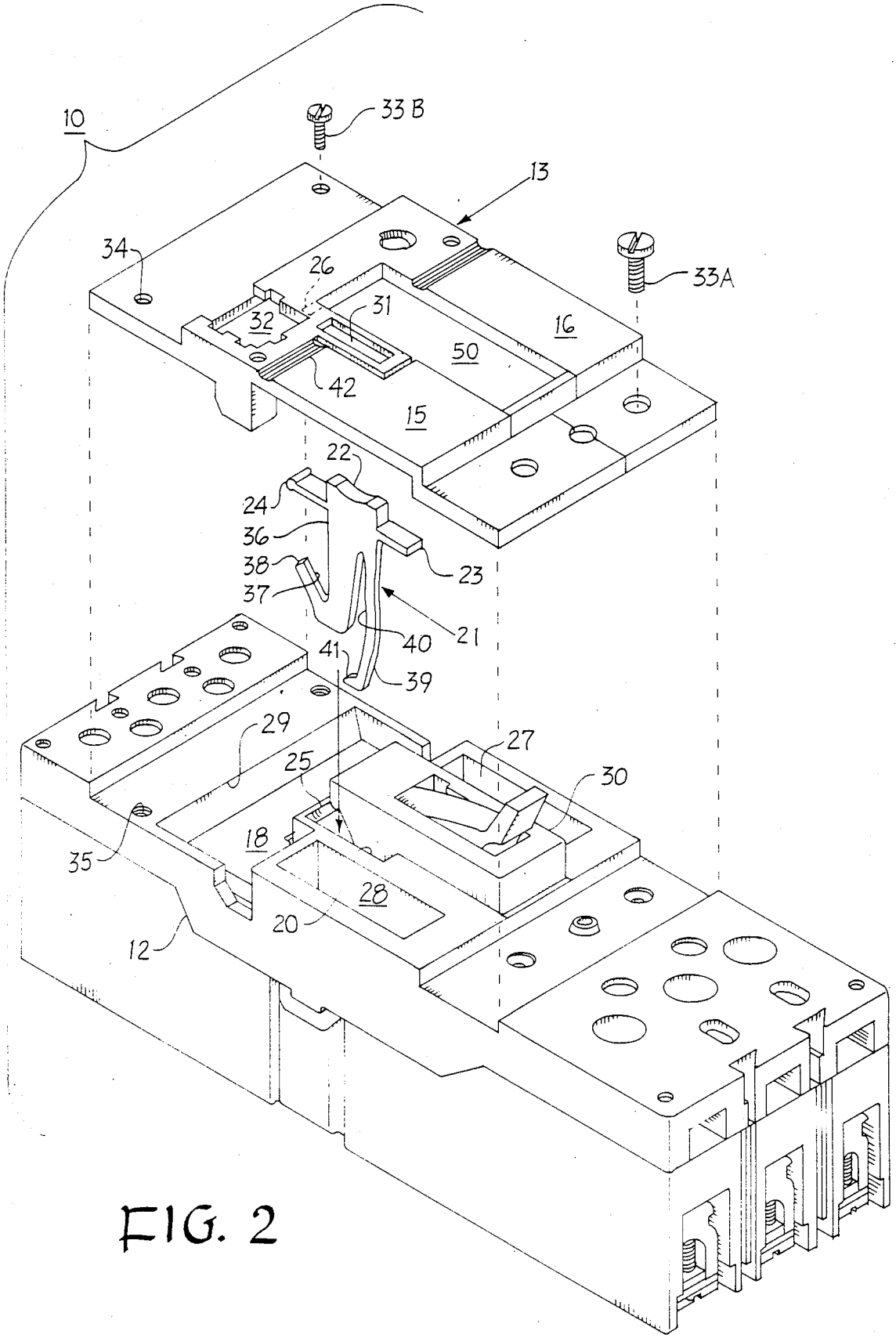
FIG. 2 is a top perspective view of the circuit breaker of FIG. 1 prior to assembly of the trip test assembly unit and accessory cover to the circuit breaker cover.

An industrial-rated molded case circuit breaker 10 is depicted in FIG. 1 and consists of a circuit breaker case 11 that contains the circuit breaker contacts (not shown) that are automatically interrupted by means of a trip unit 18. The trip unit is arranged under an accessory cover 13 which also includes a pair of accessory doors 15, 16 and which accommodates a rating plug 17. The function of the accessory cover and rating plug along with the accessories contained under the accessory doors is fully described within aforementioned U.S. Pat. No. 4,754,247. An operating handle 14 extends up from the circuit breaker cover 12 through a handle access slot 9 for manual intervention to turn the circuit breaker contacts between their open and closed positions. In accordance with the invention, a "push-to-trip" trip test button 22 extends through an access slot 20 for providing a test function such as described within the aforementioned U.S. Pat. Nos. 3,671,890 and 4,740,768. The trip test assembly unit 21, hereafter "trip test unit", is down-loaded within the access slot 20 in the manner best seen by referring now to FIG. 2.

The circuit breaker 10 is depicted prior to insertion of the trip test unit within the circuit breaker cover 12 and the attachment of the accessory cover 13 thereto. The circuit breaker cover 12 is fully described in aforementioned U.S. Pat. No. 4,754,247 and includes the trip unit 18 connected within the trip recess 29 and further includes accessory recesses 27, 28 as well as the trip test button access slot 20. The accessory cover 13 defines a centrally-arranged rectangular slot 50 which receives the operating handle escutcheon 30 upstanding from the circuit breaker cover as well as the test button slot 31. The accessory doors 15, 16 are integrally attached to the accessory cover by means of a hinge 42 which allows the accessory doors to be jointly rotated to an open position when the accessory cover is attached to the circuit breaker cover by means of screws 33A, 33B, thru-holes 34 and threaded openings 35. To open the accessory cover, the forward screws 33A are removed while the rear screws 33B remain fastened to the circuit breaker cover. The rating plug shown earlier in FIG. 1 is fitted within the rating plug recess 32 such that the rating plug extends down to and connects with that part of the trip unit 18 that underlies the rating plug recess. The trip test unit 21 is formed from a single piece of thermoplastic material with the trip button 22 arranged on top of a horizontal lever arm 23 which terminates at a ball 24 formed at one end. A planar central body member 36 extends from the lever arm and is shaped to include a trip arm 38 separated from the body member by means of a wide V-shaped slot 37. Also extending from the lever arm is an elongated return arm 39 separated from the body member by means of a narrow elongated slot 40 which terminates at a cam-follower 41 formed at the opposite end of the return arm. When the trip test unit is inserted within the trip button access slot 20, the ball 24 rests on the radial trough 25 formed within the circuit breaker cover at one end of the slot. When the accessory cover is attached to the circuit breaker cover, the complementary radial trough 26 formed on the underside of the accessory cover captures the top part of the ball 24 to form a ball and socket joint in combination with the radial trough 25.

Figure 3A:
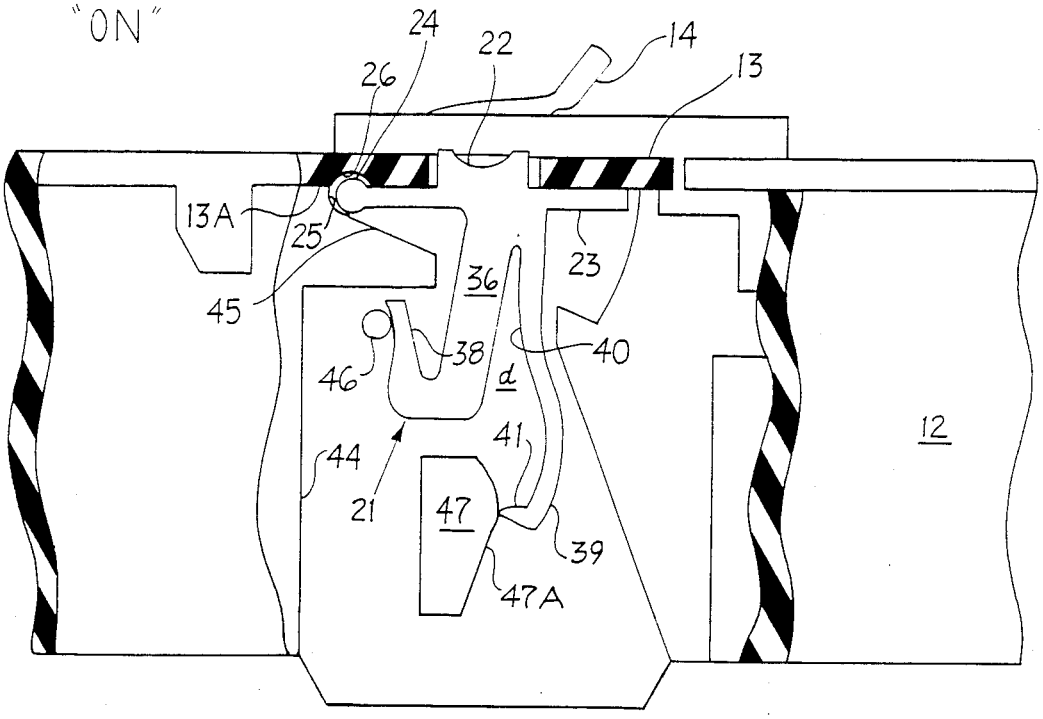
FIGS. 3A and 3B are enlarged side views, in partial section depicting the operation of the trip test assembly unit of FIG. 2.
Figure 3B:
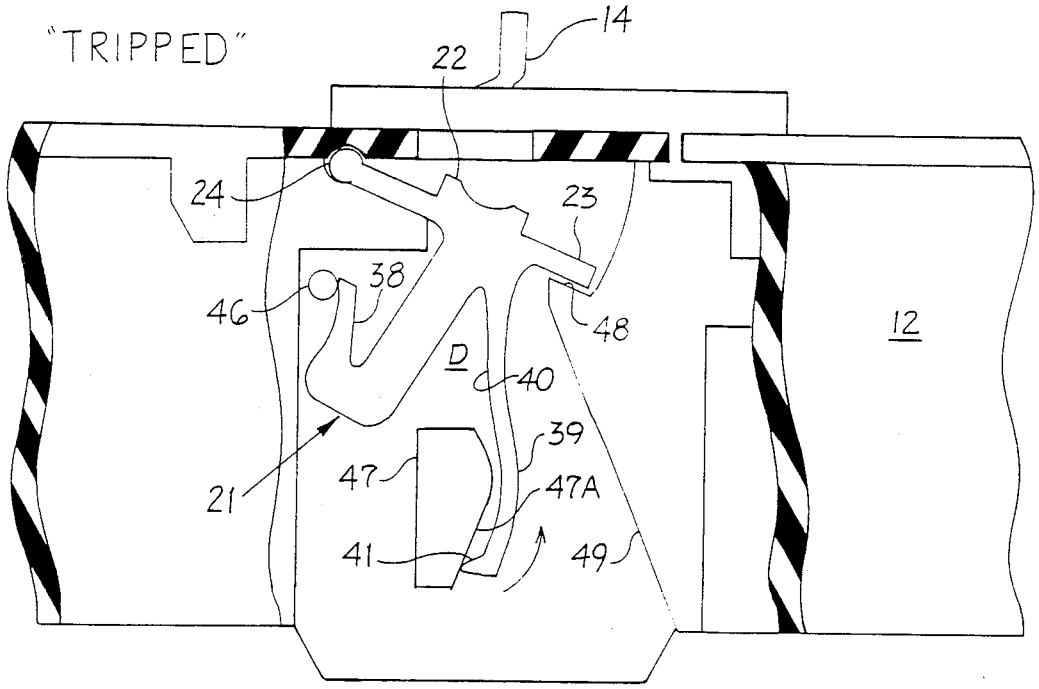

The operation of the trip test assembly 21 is best seen by referring now to FIGS. 3A and 3B. In FIG. 3A, the circuit breaker cover 12 is depicted with the operating handle 14 in the "ON" position and with the trip test assembly in its normal position within the accessory cover 13. The trip test button 22 is arranged within the cover such that the lever arm 23 abuts against the bottom surface 13A of the accessory cover and the ball 24 at the end of the lever arm is held against the radial trough 26 formed on the bottom surface of the accessory cover by the tension exerted upon the trip test unit by the return arm 39. The cam-follower 41 at the end of the return arm is flexed against the top of the cam-shaped surface 47A on the support post 47 integrally-formed within the circuit breaker cover 12. The tension exerted by the return arm 39 defines a minimum width d to the elongated slot 40 formed between the body member 36 and the return arm. In this position, the trip arm 38 abuts the circuit breaker trip bar 46 located intermediate a post 44, formed in the circuit breaker cover and the trip arm. The post supports a top extension 45 within which the radial trough 25 is formed. When the trip test button 22 is depressed, as depicted in FIG. 3B, the lever arm 23 rotates downwardly about the ball 24 until it contacts a stop 48 formed in the support post 49 formed within the circuit breaker cover 12. The trip arm 38 drives the trip bar 46 to the position shown in FIG. 3B causing the circuit breaker to become tripped as indicated by the position of the operating handle 14. The cam-follower 41 at the end of the return arm 39 moves to the lowest point on the cam-shaped surface 47A causing the elongated slot 40 to increase to a maximum width D and thereby cause the trip test unit 21 to flex between leg 39 and surface 41 and generate a return motive force in the indicated direction. The lever arm 23 thereby rotates back in the opposite direction about the ball 24 until it stops against the underside surface of the accessory cover. This automatically positions the trip test button 22 to the rest position indicated earlier in FIG. 3A. A trip test assembly is herein been described whereby the cam-follower on the return arm of the unit interacts with a camming surface on the circuit breaker cover interior. The externally accessible trip test button then rotates back to its initial position after the trip arm on the trip test assembly has contacted the circuit breaker trip bar.

Having thus described our invention, what we claim as new and desire to secure by Letters Patent is:

1. A circuit breaker comprising:

a circuit breaker case and cover;

a pair of contacts within said case controlled by an operating mechanism for both closing and opening said contacts; and a trip test unit pivotally arranged within said circuit breaker cover by means of a ball and socket joint, said trip test unit including a button externally accessible, whereby depressing said button causes said trip test unit to articulate said operating mechanism to separate said contacts.

2. The circuit breaker of claim 1 including an accessory cover attached to said circuit breaker cover.

3. The circuit breaker of claim 2 including a radial groove formed in said circuit breaker cover, said cover radial groove forming a first part of said ball and socket joint.

4. The circuit breaker of claim 3 including a radial groove formed in said accessory cover, said accessory cover radial groove forming a second part of said ball and socket joint.

5. The circuit breaker of claim 1 wherein said trip test unit comprises a unitary plastic piece having a lever arm arranged perpendicular to a depending body member, said lever arm terminating in a ball comprising the ball in said ball and socket joint.

6. The circuit breaker of claim 5 wherein said trip test includes a trip arm extending from one side of said body member, said trip arm arranged proximate a trip bar.

7. The circuit breaker of claim 6 wherein said trip test includes a return arm extending from said lever arm on an opposite side of said body member, said return arm terminating in a cam-follower at an end opposite said lever arm.

8. The circuit breaker of claim 7 wherein said trip test including a first slot defined between said trip arm and said body member.

9. The circuit breaker of claim 8 wherein said trip test includes a second slot defined between said return arm and said body member.

10. The circuit breaker of claim 7 including a first support formed within said circuit breaker cover on one side of said return arm, said support including a cam-shaped surface receiving said cam-follower.

11. The circuit breaker of claim 10 including a second support formed within said circuit breaker cover on an opposite side of said return arm, said second support including a stop formed on one surface.

12. The circuit breaker of claim 11 wherein one end of said lever arm on said trip test contacts said stop when said button is depressed.

13. The circuit breaker of claim 6 wherein said trip arm on said trip test contacts said trip bar when said button is depressed.

14. The circuit breaker of claim 10 wherein said cam-follower on said trip test moves from a first position on said cam when said first depressed to a second position on said cam when said button is depressed further thereby causing said second slot to increase in width as said cam-follower moves from said first to said second positions.

15. The circuit breaker of claim 1 wherein said circuit breaker cover includes a slot receiving said trip test unit.

16. The circuit breaker of claim 2 wherein said accessory cover includes a slot receiving a part of said trip test button.

17. The circuit breaker of claim 2 including a stop on a bottom surface of said accessory cover.

* * * * *

UNITED STATES PATENT AND TRADEMARK OFFICE

CERTIFICATE OF CORRECTION

PATENT NO. : 4,982,173

DATED : January 1, 1991

INVENTOR(S) : David J. Meiners, Roger N. Castonguay, David Arnold

It is certified that error appears in the above-identified patent and that said Letters Patent is hereby corrected as shown below:

COLUMN 4;

Claim 6, line 25, after "test" insert --unit--.
Claim 7, line 28, after "test" insert --unit--.
Claim 8, line 33, after "test" insert --unit includes--; delete "including".
Claim 9, line 36, after "test" insert --unit--.
Claim 12, line 48, after "test" insert --unit--.
Claim 13, line 51, after "test" insert --unit--.
Claim 14, line 54, after "test" insert --unit--; line 3, after "when said" insert --button is--.

Signed and Sealed this

Twenty-eighth Day of April, 1992

*Attest:*

HARRY F. MANBECK, JR.

*Attesting Officer*

*Commissioner of Patents and Trademarks*